US009945003B2

(12) United States Patent
Sowden et al.

(10) Patent No.: US 9,945,003 B2
(45) Date of Patent: Apr. 17, 2018

(54) IMPACT RESISTANT DUCTILE IRON CASTINGS

(71) Applicant: Strato, Inc., Piscataway, NJ (US)

(72) Inventors: Ike S. Sowden, Columbus, NJ (US); Jason Reiling, Hillsborough, NJ (US)

(73) Assignee: STRATO, INC., Piscataway, NJ (US)

( * ) Notice: Subject to any disclaimer, the term of this patent is extended or adjusted under 35 U.S.C. 154(b) by 421 days.

(21) Appl. No.: 14/850,033

(22) Filed: Sep. 10, 2015

(65) Prior Publication Data

US 2017/0073784 A1 Mar. 16, 2017

(51) Int. Cl.

| | |
|---|---|
| ***C21D 5/04*** | (2006.01) |
| ***B22D 15/00*** | (2006.01) |
| ***B22D 27/04*** | (2006.01) |
| ***B22D 30/00*** | (2006.01) |
| ***C21D 9/00*** | (2006.01) |
| ***C21D 9/40*** | (2006.01) |
| ***C22C 37/08*** | (2006.01) |
| ***C22C 37/10*** | (2006.01) |

(52) U.S. Cl.

CPC ..... *C21D 5/04* (2013.01); *B22D 15/00* (2013.01); *B22D 15/005* (2013.01); *B22D 27/04* (2013.01); *B22D 30/00* (2013.01); *C21D 9/0068* (2013.01); *C21D 9/40* (2013.01); *C22C 37/08* (2013.01); *C22C 37/10* (2013.01)

(58) Field of Classification Search

CPC ..... C21D 5/04; C21D 9/40; C21D 9/0068; C22C 37/10; C22C 37/08

See application file for complete search history.

(56) References Cited

U.S. PATENT DOCUMENTS

| | | | | |
|---|---|---|---|---|
| 2,970,902 | A | 2/1961 | Alexander et al. | |
| 3,055,755 | A | 9/1962 | Schelleng | |
| 3,799,767 | A | 3/1974 | Malizio et al. | |
| 4,040,875 | A * | 8/1977 | Noble | B21C 1/26 148/321 |
| 5,482,675 | A | 1/1996 | Shotwell et al. | |
| 6,258,180 | B1 | 7/2001 | Wilde et al. | |
| 7,846,381 | B2 | 12/2010 | Braga | |
| 2009/0191085 | A1 | 7/2009 | Braga | |
| 2010/0294452 | A1 | 11/2010 | Berthelet | |
| 2011/0017364 | A1 | 1/2011 | Park et al. | |

FOREIGN PATENT DOCUMENTS

| | | |
|---|---|---|
| CA | 1302742 | 6/1992 |
| EP | 2 749 658 | 7/2014 |
| EP | 2 765 214 | 8/2014 |
| WO | WO 84/02924 | 8/1984 |
| WO | WO 2008/128334 | 10/2008 |

OTHER PUBLICATIONS

Standard Test Method for Evaluating the Microstructure of Graphite in Iron Castings, Designation A247-10, ASTM Int'l, Apr. 2010, pp. 1-4, 100 Barr Harbor Drive, PO Box C700, West Conshohocken, PA 19428-2959.

Standard Test Methods and Definitions for Mechanical Testing of Steel Products, Designation A370-14, ASTM Int'l, Jul. 2014, pp. 1-50, 100 Barr Harbor Drive, PO Box C700, West Conshohocken, PA 19428-2959.

Standard Specification for Ductile Iron Castings, Designation A536-84, ASTM Int'l, Aug. 2009, pp. 1-5, 100 Barr Harbor Drive, PO Box C700, West Conshohocken, PA 19428-2959.

Mahto, "Characterization of Ductile Iron through Fractographic Study", Department of Metallurgical and Materials Engineering, National Institute of Technology, Rourkela, Odisha, India, May 2014, pp. 1-51.

International Search Report and Written Opinion for PCT International Application No. PCT/US2016/046275 dated Oct. 20, 2016.

* cited by examiner

*Primary Examiner* — Jessee Roe

(74) *Attorney, Agent, or Firm* — Pearl Cohen Zedek Latzer Baratz LLP

(57) ABSTRACT

A highly impact resistant ductile iron casting is made from a specified high nickel content ductile iron composition and post-treated with a specified heating and cooling profile to achieve an elongation exceeding the ASTM A536 ("60-40-18") standard, and meeting or exceeding Charpy V Notch impact resistance at −20° F. of greater than 11.0 ft.lbs.

17 Claims, 1 Drawing Sheet

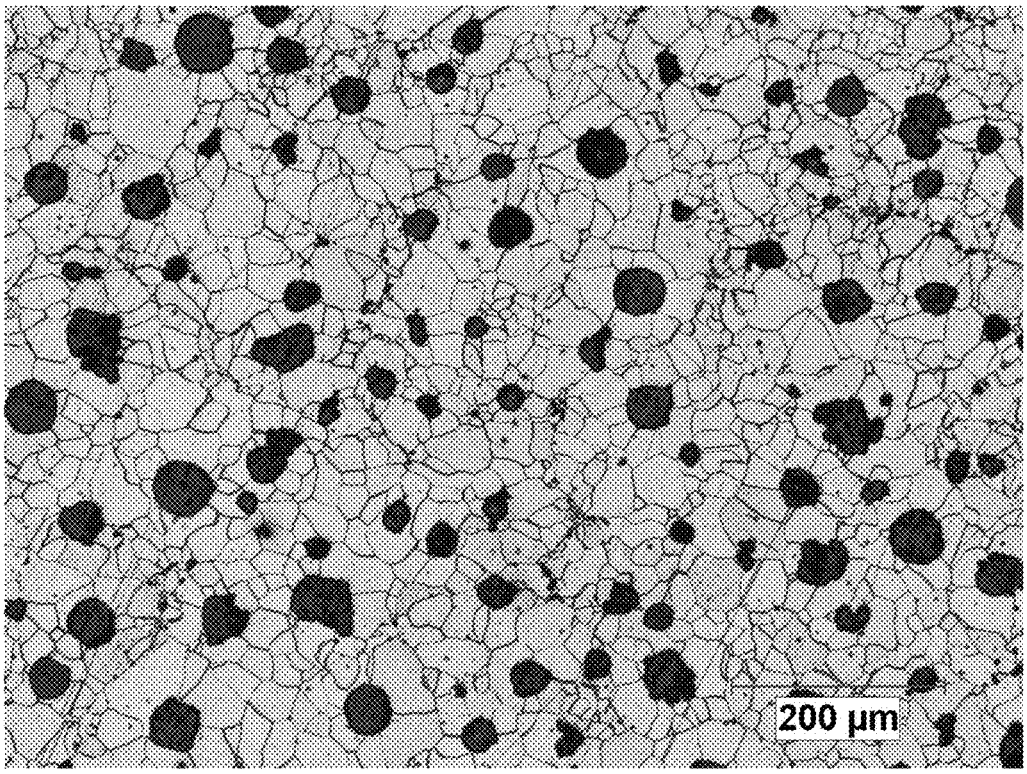
200 μm

IMPACT RESISTANT DUCTILE IRON CASTINGS

FIELD OF THE INVENTION

The present invention is directed generally to impact resistant ductile iron compositions and castings, and to methods for making highly impact resistant ductile iron castings for use in the railcar industry.

BACKGROUND OF THE INVENTION

Ductile iron is conventionally produced by adding nodularizing agents such as cerium or magnesium to molten iron that normally would produce a soft, weak grey iron casting. The addition of the alloying elements results in castings in which the carbon content (as graphite) is present in spheroidal form, which provides the casting with greater ductility than ordinary grey iron. Several types of matrix microstructures can be developed by alloying or heat treatment, such as pearlitic or ferritic matrices. Ductile iron may be defined with respect to a standard, such as American Society of Testing and Materials ("ASTM") Standard A536, which specifies certain standard properties for ductile iron including: a tensile strength of at least 60 ksi, yield strength of at least 40 ksi and elongation of at least 18%, as well as methods for measuring those properties. In the industry, ductile iron meeting the ASTM A536 Standard is often referred to as "60-40-18" ductile iron.

Methods and alloys have been disclosed in the prior art for producing ductile cast iron with enhanced properties, including PCT International Patent Application Publication No. WO 1984/02924, which teaches a method for making a high-strength ferritic ductile iron by increasing the silicon, nickel and molybdenum contents of a relatively high carbon ductile iron composition to form an alloy consisting essentially of, by weight: silicon (Si) in a range of 3.9-6.0%; carbon (C) in a range of 3.0-3.5%; manganese (Mn) in a range of 0.1-0.3%; molybdenum (Mo) in a range of 0-0.35%; at least 1.25% nickel (Ni); no greater than 0.015% sulfur (S); and phosphorus (P) present at 0.06%; the remainder being iron (Fe). The casting produced is annealed to increase ferrite in the microstructure. While this composition has very high tensile strength and yield strength, this composition has insufficient elongation and toughness properties for the railcar applications contemplated by the present application.

U.S. Pat. No. 7,846,381, which is incorporated by reference, teaches high carbon, high silicon content cast iron formed with minimized nickel content, and without annealing, to obtain parts having high toughness. The resulting cast iron is described as ferritic, but may contain significant pearlite microstructure. The cold temperature toughness of the resulting product as measured by the Charpy V Notch test at −20° F. is only 6 ft. lb, which needs improvement. Thus, arriving at a desired combination of properties, which are sometimes competing in an iron alloy, is often elusive.

SUMMARY OF THE INVENTION

The inventors herein have developed iron alloys and heat treatments for cast iron that achieve better elongation properties and low temperature impact resistance compared to the prior art while maintaining standard tensile strength and yield strength. The alloys and castings of the present invention find particular utility in the railcar industry, in the manufacture of equipment found under the railcar, located on the truck of the rail car by the wheels, including bearing housings, lifting hooks and chevron adapters. Because these castings are close to the ground, they are subject to being impacted by debris, and require high impact strength in a wide range of environmental conditions. Additionally, as trains become faster and heavier, the vibrational forces experienced by truck castings increases. A more ductile casting with elongation above the 18% set forth in the ASTM A536 Standard may be able to absorb more vibration. At the same time, it is desirable to maintain the yield strength and tensile strength of these castings within the current 60-40-18 standard to accommodate heavier car loads and help save fuel by reducing the tare weight of the car. In particular, it is desired to increase the low temperature impact resistance of a 60-40-18 cast iron and increase the elongation.

In one aspect, the invention is a ductile iron alloy composition having a carbon content in a range of 3.75% to 3.93%, higher than a conventional grey or white cast iron. Manganese is also present in the composition in a range of 0.10% to 0.19%. Phosphorus may be present in an amount up to 0.032%. Sulfur may be present in an amount up to 0.021%. Silicon is present in a range of 1.95% to 2.39%. Nickel is present in a range of 0.81% to 0.99% and copper in a range of 0.02% to 0.09%. In embodiments, the carbon in the composition is present in a range of 3.75% to 3.90%; the silicon is present in a range of 2.08% to 2.39%; the manganese is present in a range of 0.11% to 0.19%; and the sulfur is present in an amount up to 0.016%.

The composition is hypereutectic, with a Carbon Equivalence ("CE") greater than 4.3. In embodiments, the CE is equal to or greater than 4.53. A casting made from the alloy has a tensile strength of at least 58,000 psi; yield strength at least 38,000 psi; elongation at least 21%; and Charpy V notch impact resistance at −20° F. of greater than 11 ft. lbs. In preferred embodiments according to the invention, a casting made with the ductile iron alloy of the invention has a tensile strength of 60,000 psi, a yield strength of 40,000 psi (i.e., meeting the ASTM A536 Standard), an increased elongation of at least 22% and a Charpy V Notch impact resistance at −20° F. of at least 11 ft. lbs. The resulting high elongation combined with high impact resistance at low temperatures has not previously been achieved in the art, and has particular utility in the manufacture of castings used in the rail industry, such as underneath a rail car.

The properties of tensile and yield strength similar to conventional ductile iron, yet with superior elongation and cold-temperature impact resistance, are achieved with the above composition and a heat treatment. According to the heat treatment, after casting an iron alloy having the above composition, the resulting casting is heated to a first temperature in a range of 1650° F. to 1675° F.; thereafter maintained at said first temperature in a range of 1650° F. to 1675° F. for one hour per inch of thickness of the iron casting plus one hour; and thereafter cooled to a temperature of about 1200° F. over a period of at least about 6 hours; and thereafter cooling the iron casting to room temperature to form a finished ductile iron casting having a tensile strength of at least 58,000 psi; yield strength at least 38,000 psi; elongation at least 21%; and Charpy V notch impact resistance at −20° F. of greater than 11 ft. lbs.

BRIEF DESCRIPTION OF THE DRAWINGS

The subject matter regarded as the invention is particularly pointed out and distinctly claimed in the concluding portion of this specification. The invention, however, both as to organization and method of operation, together with objects, features, and advantages thereof, may best be understood by reference to the following detailed descriptions when read with the accompanying drawings in which:

FIG. 1 is a micrograph of a cast part made according to an embodiment of the invention showing 100% ferritic structure.

DETAILED DESCRIPTION OF THE INVENTION

In the following detailed description, numerous specific details are set forth in order to provide a thorough understanding of the invention. However, it will be understood by those of ordinary skill in the art that the present invention may be practiced without these specific details. In other instances, well-known methods, procedures, and/or components have not been described in detail so as not to obscure the present invention.

As used herein, the terms "iron," "cast iron," and "iron composition" usually refer to iron alloys. It will be clear from the context where the specification necessarily refers to pure or elemental iron.

Reference herein to an "ASTM Standard", refers to an American Society of Testing and Materials Standard in effect on the filing date of this application. These standards are part of the general knowledge and as such are incorporated by reference. Specifically, ASTM Standard A536 specifies certain standard properties for ductile iron. Reference herein individually to tensile strength, yield strength and elongation also references the respective procedures for measuring these properties described in the ASTM A536 Standard.

The term "Charpy V Notch" refers to the preparation of a sample for impact testing per ASTM Standard A370, which is incorporated by reference. Impact testing measures a material's toughness, its ability to absorb energy prior to fracturing. The Charpy V Notch test conducted on cast iron will yield markedly different results when conducted at −20° F. and at 72° F.

In cast iron, a Carbon Equivalence (CE) is commonly used to determine if a composition is eutectic, hypoeutectic, or hypereutectic. A value of 4.3 indicates a eutectic composition. A value less than 4.3 indicates a hypoeutectic composition and a value greater than 4.3 indicates a hypereutectic composition. The following equation is used to calculate CE, taking into account non-carbon alloy elements in an iron composition:

$$CE=\%\ C+0.33(\%\ Si+\%\ P)$$

Ductile iron generally has a nodular structure in which the carbon forms nodules in the alloy observed at the microscopic level. The term "ferritic microstructure" refers to a soft, low carbon phase which surrounds the carbon (graphite) nodules in ductile iron.

A "profile" refers to a sequence of heating and/or cooling steps over a period of time, represented by a graph of temperature versus time.

"Room temperature" means about 65° F. to about 80° F.

Certain numerical limitations herein are modified with "about" to allow for accepted tolerances in measurement.

The composition of the present invention has a high carbon equivalence (CE) greater than 4.3, also referred to as a hypereutectic composition. In embodiments, a ductile iron according to the invention has CE equal to or greater than 4.53. This is achieved with a high carbon content in a range of 3.75% to 3.93%, in embodiments in a range of 3.75% to 3.90%, and other components that add to the CE, including silicon. Silicon according to the invention is added to the alloy in a range of 1.95% to 2.39%, preferably in a range of 2.08% to 2.39%. Silicon has been added to cast iron to increase tensile strength, but too great addition of silicon is believed to reduce elongation and negatively affect impact resistance. The contribution of individual components to the properties of the alloy cannot be considered in isolation. Nickel, present in a range of 0.81% to 0.99%, is believed to positively impact the elongation and toughness of the finished product. Nickel behaves in some respects like silicon in the Fe-C-Si-Ni system, and is believed to afford advantages of adding silicon without the drawbacks of too great an addition of silicon. Molybdenum, which in the prior art is often used in conjunction with Ni, is optionally present, but maintained at very low levels. Manganese is also present in the composition in a range of 0.10% to 0.19%, in embodiments in a range of 0.11% to 0.19%. Phosphorus is optionally present in an amount up to 0.032%. Sulfur is optionally present in an amount up to 0.021%, in embodiments up to about 0.016%. copper is present in a range of 0.02% to 0.09%. All percentages are by weight with respect to the solid iron composition.

The objective of the hypereutectic composition is to ensure that a ductile iron with 100% ferritic microstructure can be obtained, generally using a heat treatment, as ferritic microstructure is believed to be important for maintaining good elongation and toughness properties. A heat treatment is used to resolve pearlite in the iron to ferrite. In the heat treatment, the iron is heated above the critical temperature to about 1650-1675° F. and held at this temperature for one hour per inch of cross sectional thickness plus one hour. Thereafter, the part is furnace-cooled to about 1200° F. with a controlled maximum rate of 40° F./hour between 1450° F. and 1200° F.

EXAMPLES AND TESTING

Example 1

A casting for a bearing housing of a railway car prepared according to the invention was found to have the following composition:

TABLE 1

| Alloying Element | wt % |
|---|---|
| Carbon | 3.93 |
| Manganese | .15 |
| Phosphorus | .027 |
| Sulfur | .015 |
| Silicon | 1.95 |
| Nickel | .89 |
| Chromium | .02 |
| Molybdenum | <.01 |
| Copper | .08 |
| Magnesium | .02 |

The Carbon Equivalence of the above composition was 4.59.

Heat treatment may be conducted after the desired part is cast to remove pearlitic microstructure, and in preferred embodiments, to ensure that the cast part possess 100% ferritic microstructure. Samples having 100% ferritic structure were found to have the desired combination of strength, elongation and cold temperature impact resistance. In the heat treatment profile, the sample is heated above the critical temperature to about 1650-1675° F. and held at this temperature for one hour per inch of cross sectional thickness plus one hour (in the specific embodiment of Example 1, about 3 hours). Thereafter, the part is furnace-cooled to about 1200° F. with a controlled maximum rate of 40° F./hour between 1450° F. and 1200° F. In embodiments, the microstructure of the iron alloy according to the invention has a nodularity of at least about 90%, in other embodiments, at least about 95% nodularity.

After heat treatment, the part identified in Table 1 was found to have 100% ferritic structure. The sample was evaluated according to ASTM A247 and shown to have a nodularity of 95% and 100 nodules/mm$^2$. Graphite was determined to be 33% Type I and 67% Type II.

The ductile iron of the present invention represents an improvement over conventional 60-40-18 iron for certain transit applications in terms of low temperature impact resistance. Castings according to the invention preferably have an impact resistance, measured by a Charpy V Notch at −20 ° F. of at least 9.0 ft. lbs. Preferably, castings according to the invention have a resistance of 10.0 ft. lbs in the Charpy V-Notch test. In embodiments, castings according to the invention have a resistance of 11.0 ft. lbs in the Charpy V-Notch test. In the Example above, 10 mm×10 mm samples were tested three times and an average was taken, yielding a measured impact resistance of 12.6 ft-lbs. In embodiments, the cast parts made with the ductile iron of the present invention have a maximum thickness of 4 inches.

Tensile strength, yield strength and elongation of the above sample were measured according to ASTM A536 and the following values were obtained

TABLE 2

| | |
|---|---|
| Tensile Strength, psi | 58,500 |
| Yield Strength, psi (.2% Offset) | 38,300 |
| % Elongation in 2" | 22 |

Thus a suitable cast iron according to the invention has a tensile strength at least about 58,000 psi. In embodiments (in Example 2, for example) a tensile strength of at least about 60,000 psi may be obtained. A suitable cast iron has a yield strength at least about 38,000 psi, and in embodiments (see Example 2) a yield strength of at least about 40,000 psi is obtained. Elongation of a cast iron according to the invention is at least 20%; in embodiments 21% or greater; and in other embodiments greater than or equal to 22%.

Example 2

A casting for a bearing housing of a railway car similar Example 1 was found to have the following composition:

TABLE 3

| Alloying Element | wt % |
|---|---|
| Carbon | 3.81 |
| Manganese | .15 |
| Phosphorus | .030 |
| Sulfur | .013 |
| Silicon | 2.19 |
| Nickel | .90 |
| Chromium | .02 |
| Molybdenum | <.01 |
| Copper | .06 |
| Magnesium | .04 |

The Carbon Equivalence of the above composition was 4.55.

Heat treatment was conducted with the same profile as in Example 1 to remove pearlitic microstructure. A micrograph of the sample is shown in FIG. 1 which was evaluated according to ASTM A247 and determined to have a nodularity of at least about 90%, with 50 nodules per mm$^2$. Graphite was determined to be 33% Type I and 67% Type II.

Charpy V Notch testing at −20° F. was conducted on three 10 mm×10 mm samples, and an average was taken, yielding a measured impact resistance of 11.6 ft. lbs. Tensile strength, yield strength and elongation of Example 2 were measured according to ASTM A536 and the following values were obtained:

TABLE 4

| | |
|---|---|
| Tensile Strength, psi | 60,500 |
| Yield Strength, psi (.2% Offset) | 41,200 |
| % Elongation in 2" | 22 |

which demonstrates that a casting meeting the ASTM A536 standard for yield strength and tensile strength, having improved elongation and low-temperature impact properties can be achieved with an iron alloy according to the invention.

The above detailed description of the preferred embodiments is not to be considered as limiting the invention, which is defined by the appended claims. Each dependent claim herein sets forth a feature and/or property which may be combined with a feature and/or property described in another dependent claim. The claims should be construed broadly to cover equivalent materials and practices that would be evident to the person of ordinary skill in the art reading the claims in light of the above detailed description.

The invention claimed is:

1. A ductile iron alloy composition having carbon present in a range of 3.75 wt % to 3.93 wt %; manganese present in a range of 0.10 wt % to 0.19 wt %; phosphorus present in an amount up to 0.032 wt %; sulfur present in an amount up to 0.021 wt %; silicon present in a range of 1.95 wt % to 2.39 wt %; nickel present in a range of 0.81 wt % to 0.99 wt %; copper present in a range of 0.02 wt % to 0.09 wt %; and having a Carbon Equivalence greater than 4.3; the iron composition having a tensile strength of at least 58,000 psi; yield strength at least 38,000 psi; elongation at least 21%; and Charpy V notch impact resistance at −20° F. of at least 11 ft.lbs.

2. The ductile iron alloy composition according to claim 1, wherein the carbon is present in a range of 3.75 wt % to 3.90 wt %, the silicon is present in a range of 2.08 wt % to 2.39 wt %; the manganese is present in a range of 0.11 wt % to 0.19 wt %; and the sulfur is present in an amount up to 0.016 wt %.

3. The ductile iron alloy composition according to claim 1 having a tensile strength of at least 60,000 psi and yield strength of at least 40,000 psi.

4. The ductile iron alloy composition according to claim 1, wherein the composition is a casting having a maximum thickness up to 4 inches.

5. The ductile iron alloy composition according to claim 4, having a microstructure formed by heating to a first temperature in a range of 1650° F. to 1675 F; thereafter held at said first temperature for one hour per inch of thickness of the iron casting plus one hour; thereafter cooled in a furnace to a temperature of about 1200° F. over a period of at least about 6 hours; and thereafter cooled to room temperature.

6. The ductile iron alloy composition according to claim 1, wherein the composition is a casting used in the rail industry.

7. The ductile iron alloy composition of claim 6, wherein the composition is a casting selected from the group consisting of a bearing housing, a lifting hook, and a chevron adapter.

8. The ductile iron alloy composition according to claim 1, wherein the composition is hypereutectic and has a Carbon Equivalence equal to or greater than 4.53.

9. The ductile iron alloy composition according to claim 1, wherein the composition has 100% ferritic structure.

10. A method of making a hypereutectic ductile iron casting, comprising (a) casting an iron alloy having carbon present in a range of 3.75 wt % to 3.93 wt %; manganese present in a range of 0.10 wt % to 0.19 wt %; phosphorus present in an amount up to 0.032 wt %; sulfur present in an amount up to 0.021 wt %; silicon present in a range of 1.95 wt % to 2.39 wt %; nickel present in a range of 0.81 wt % to 0.99 wt %; copper in a range of 0.02 wt % to 0.09 wt %; and a Carbon Equivalence greater than 4.3 to form an iron casting; and (b) heating the iron casting to a first temperature in a range of 1650° F. to 1675° F.;

(c) thereafter, maintaining the iron casting at said first temperature in a range of 1650° F. to 1675° F. for one hour per inch of thickness of the iron casting plus one hour; and (d) thereafter cooling the iron casting in a furnace to a temperature of about 1200° F. over a period of at least about 6 hours; and (e) thereafter cooling the iron casting to room temperature to form a finished ductile iron casting having a tensile strength of at least 58,000 psi; yield strength at least 38,000 psi; elongation at least 21%; and Charpy V notch impact resistance at −20° F. of at least about 11 ft.lbs.

11. The method according to claim 10, wherein, in the iron alloy of step (a), the carbon is present in a range of 3.75 wt % to 3.90 wt %, the silicon is present in a range of 2.08 wt % to 2.39 wt %; the manganese is present in a range of 0.11 wt % to 0.19 wt %; and the sulfur is present in an amount up to 0.016 wt %.

12. The method according to claim 10, wherein step (d) of cooling the cast iron material in a furnace comprises cooling the cast iron material at a rate no faster than about 40° F. per hour from 1450° F. to 1200° F.

13. The method according to claim 10, wherein step (a) of casting an iron alloy consists of casting in a mold to form an iron casting having a maximum thickness of 4 inches.

14. The method according to claim 10, wherein step (a) of casting an iron alloy consists of casting in a mold to form an iron casting selected from the group consisting of a bearing housing, a lifting hook, and a chevron adapter.

15. The method according to claim 10, wherein after step (e) of cooling the iron casting, the finished ductile iron casting has a 100% ferritic structure.

16. The method according to claim 10, wherein the ductile iron alloy of step (a) is hypereutectic, having a Carbon Equivalence greater than about 4.53.

17. The method according to claim 10, wherein the ductile iron alloy of step (a) has a tensile strength of at least 60,000 psi and yield strength of at least 40,000 psi.

* * * * *